US005797444A

United States Patent [19]

Villanueva et al.

[11] Patent Number: 5,797,444

[45] Date of Patent: Aug. 25, 1998

[54] INGOT MOLD FOR THE CONTINUOUS CASTING OF METALS

[75] Inventors: Hector Villanueva; Dirk Rode, both of Osnabruck, Germany

[73] Assignee: KM Europa Metal Aktiengesellschaft, Osnabruck, Germany

[21] Appl. No.: 612,640

[22] Filed: Mar. 8, 1996

[30] Foreign Application Priority Data

Mar. 8, 1995 [DE] Germany ..... 195 08 169.2

[51] Int. Cl.[6] ..... B22D 11/00

[52] U.S. Cl. ..... 164/418; 164/459

[58] Field of Search ..... 164/418, 435, 164/485, 459, 443

[56] References Cited

U.S. PATENT DOCUMENTS

| | | | |
|---|---|---|---|
| 4,658,884 | 4/1987 | Euler et al. | 164/443 |
| 5,343,931 | 9/1994 | Striuli et al. | 164/418 |
| 5,360,053 | 11/1994 | Kawa et al. | 164/418 |
| 5,611,390 | 3/1997 | Benedetti et al. | 164/418 |
| 5,615,731 | 4/1997 | Roehrig et al. | 164/418 |

FOREIGN PATENT DOCUMENTS

| | | | |
|---|---|---|---|
| 3 411 359C2 | 3/1984 | Germany . | |
| 3942704 | 6/1991 | Germany | 164/443 |
| 53-119729 | 10/1978 | Japan | 164/459 |
| 4-187344 | 7/1992 | Japan | 164/443 |
| 2 177 331 | 1/1987 | United Kingdom . | |

*Primary Examiner*—Joseph J. Hail, III
*Assistant Examiner*—I.-H. Lin
*Attorney, Agent, or Firm*—Kenyon & Kenyon

[57] ABSTRACT

An ingot mold for the continuous casting of metals. The mold has a mold cavity that is open at opposing ends. The cross-sectional area at the casting pour-in-side is larger than the cross-sectional area of the end from which the billet emerges. To achieve higher casting performance and attain better billet quality via more uniform temperature distribution over the casting cross-section, the mold cavity has multiple conical depressions on an outer cooling surface. These depressions, which are arrayed over at least one area, constitute a region defining elevated heat transfer coefficients. The cooling-side surface in the bath level area of the ingot mold has a roughened structure over part of its surface, the roughened structure tapering in the casting direction.

23 Claims, 4 Drawing Sheets

INGOT MOLD FOR THE CONTINUOUS CASTING OF METALS

BACKGROUND OF THE INVENTION

The present invention relates generally to an ingot mold for the continuous casting of metal, mainly steel, and particularly to a mold having a mold cavity that is open on two opposite ends, the cross-section of the mold cavity at the pour-in-side end being larger than at the end from which the billet emerges.

There is a need for an ingot mold of this type that offers both higher casting performance and better billet quality than has hitherto been the case. At the same time, heat dissipation from the partially molten billet should be optimized so as to increase the service life of the ingot mold.

SUMMARY OF THE INVENTION

The present invention provides an ingot mold for the continuous casting of metals (primarily steel). The mold has a cavity that is open at opposed ends. The mold cavity at the inlet side is larger in cross section than the opening at the other end of the cavity. The mold utilizes a multiple conical design to optimize heat transfer rate. A series of shaped depressions on at least a portion of a heat-transfer surface on the mold facilitates cooling of the mold.

BRIEF DESCRIPTION OF THE DRAWINGS

For a more complete understanding of this invention, reference should now be made to the embodiments illustrated in greater detail in the accompanying drawings and described below. In the drawings:

In FIGS. 1 and 2, the views shown are of the curved sides of the ingot mold.

DETAILED DESCRIPTION OF THE INVENTION

Figure 1:
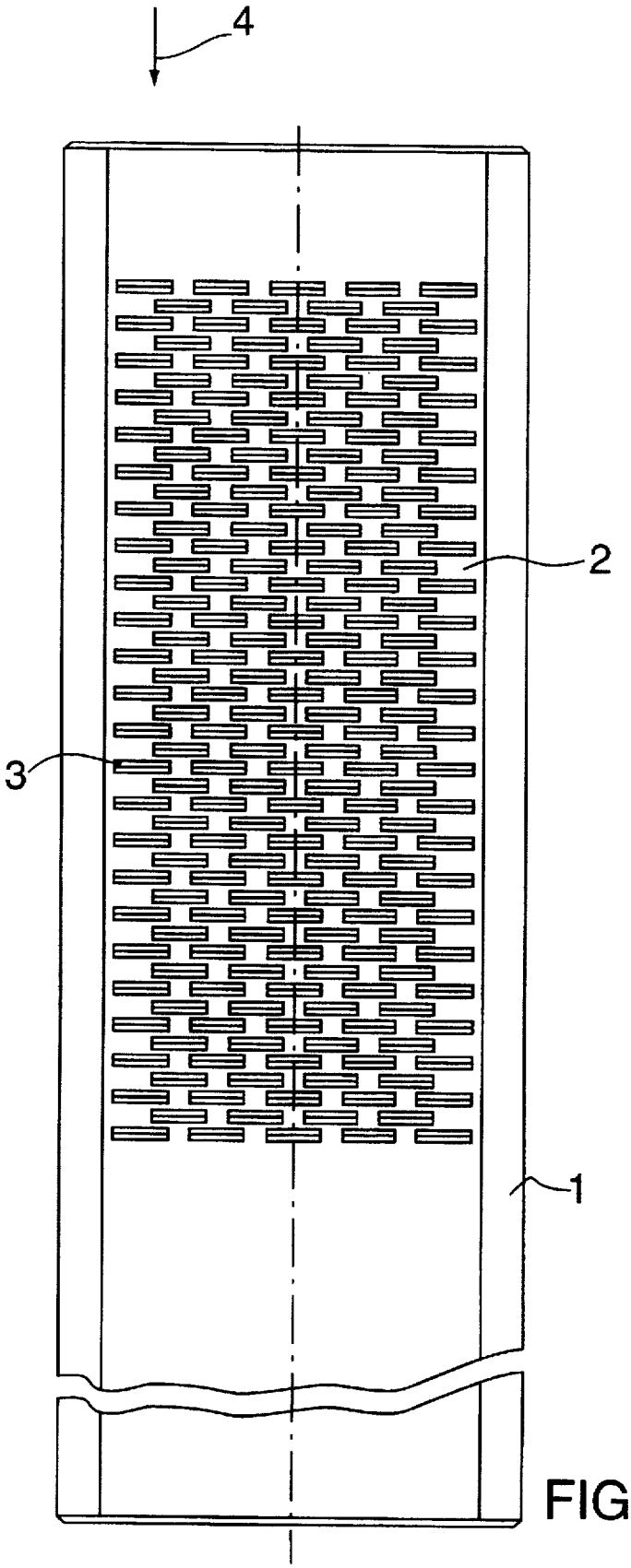
FIG. 1 a side schematic view of a first embodiment of a tubular ingot mold, constructed according to the principles of the invention.

FIG. 1 shows a tubular ingot mold 1 for the continuous casting of steel. The particular embodiment shown has a square casting cross-section of 170×170 mm$^2$. The wall thickness of the curved ingot mold 1 (the casting radius is 8,000 mm) is 18 mm. The mold cavity of the approximately 800 mm long ingot mold 1 is subdivided into two conical areas. The first area, which extends 320 mm in the casting direction, has a conicity of 2.4%/m; the adjacent 480 mm long portion has a conicity of 1%/m.

With reference to FIG. 1, a cooling-optimized area 2 is provided having depressions 3 in the cooling-side surface of the ingot mold 1. These depressions are triangular in cross-section, and extend over a partial length of approximately 310 mm that begins 60 mm downstream of the pour-in side 4.

To attain optimal solidification conditions for the steel billet during the casting operation, it has proven particularly advantageous to provide the structured cooling area 2 only on the curved exterior of the tubular ingot mold 1.

In the embodiment shown, the center-to-center distance of the depressions 3, which are triangular in cross-section, is 8 mm in the casting direction, the individual depressions 3 having a width of 4 mm. The maximum depth of the depressions 3 normal to the surface is 1.2 mm. (The foregoing dimensions of the cooling-optimized area 2 have been determined in casting-engineering tests.)

Figure 2:
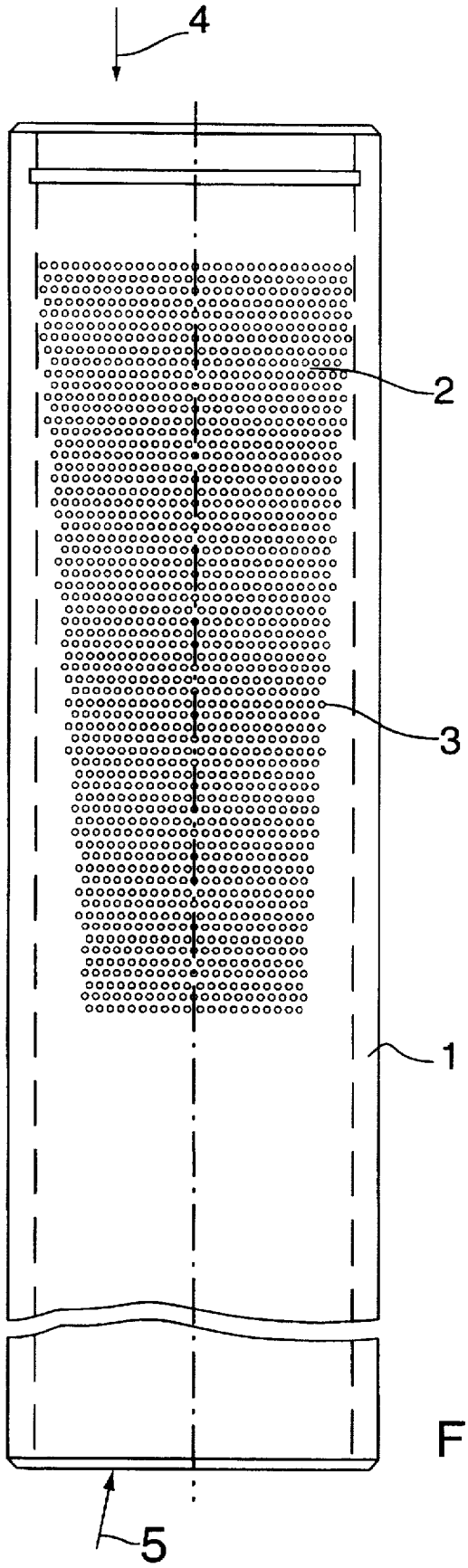
FIG. 2 is a side view of a second embodiment of a tubular ingot mold constructed according to the principles of the invention.

A second embodiment is shown in FIG. 2. The tubular ingot mold 1 (which can be shaped for the continuous casting of square cross-sections as well) has a cooling-optimized area 2 which consists of a plurality of circular depressions 3. In this embodiment, the total trapezoidal-shaped area 2 over which these depressions run has a length of 250 mm, tapering in the casting direction by about 30%. (Again, the pour-in side is designated 4 and the end at which the billet emerges is designated 5.)

Figure 6:
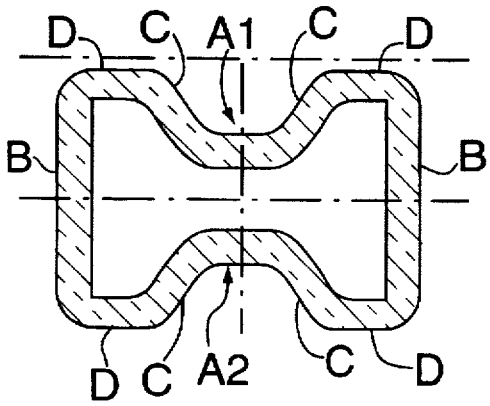
FIG. 6 illustrates a mold cavity having a double-T type cross-section.
Figure 7A:
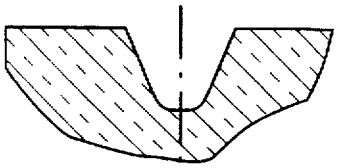
FIGS. 7*a*, 7*b*, and 7*c* illustrate in cross-section various suitable depression geometries.
Figure 7B:
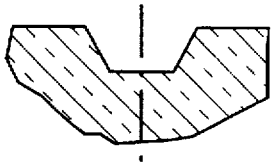
Figure 7C:
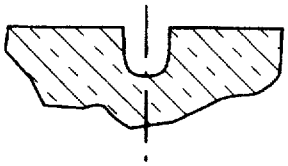

The shape of the depressions may vary. For example, the depressions may be triangular (FIG. 7*a*), trapezoidal (FIG. 7*b*), or round (FIG. 7*c*). Any one of these shapes may be used for the depressions exclusively, or the shapes may be combined. Preferably, the distance between such depressions lies within the range of 1 to 10 mm. In yet another embodiment, the ingot mold cooling surface is roughened so as to provide a pattern of sites of enhanced heat transfer. Such roughening is characterized by a mechanically applied structure with a peak-to-valley height of $R_t$>1.5 μm. Regions of depressions may be combined with areas of patterned roughening in a single mold. In the embodiment shown in FIG. 6, a double-T type mold is provided with both regions of depressions (A1 and A2) and roughened zones (B, C, and D). Whatever the shape employed, these regions of enhanced heat transfer are generally located over the area of the mold where optimized heat dissipation is desired.

Figure 3:
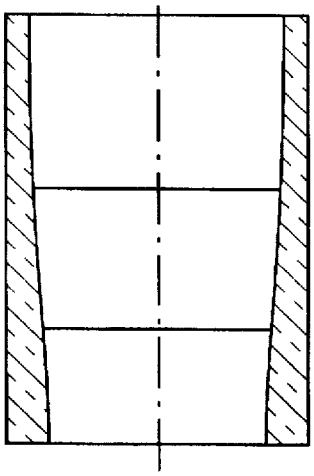
FIG. 3 is a cross-sectional view of a mold cavity having triple conicity.
Figure 4:
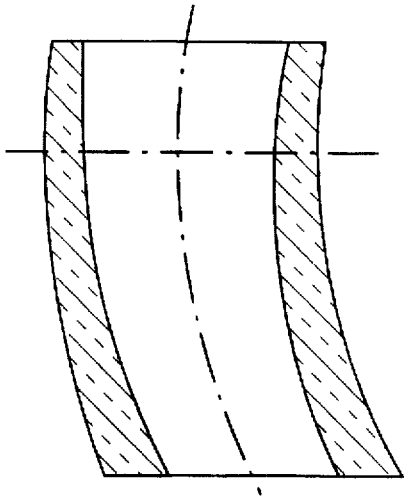
FIG. 4 is a cross-sectional view of a mold cavity having a curved longitudinal axis.
Figure 5A:
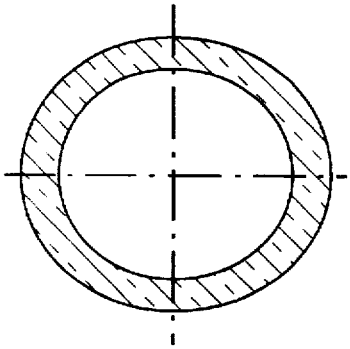
FIGS. 5*a*, 5*b*, and 5*c* illustrate mold cavities having round, square, and polygonal cross-sections, respectively.
Figure 5B:
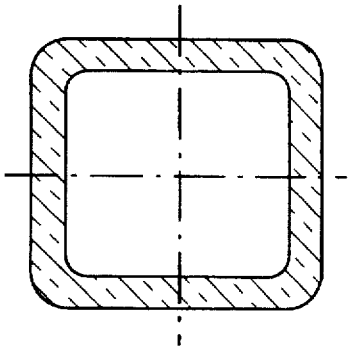
Figure 5C:
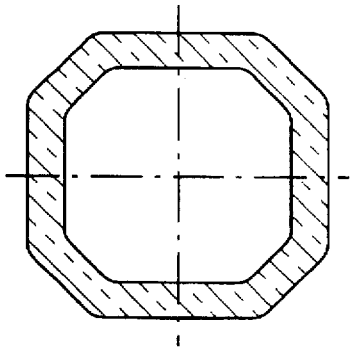
Figure 8A:
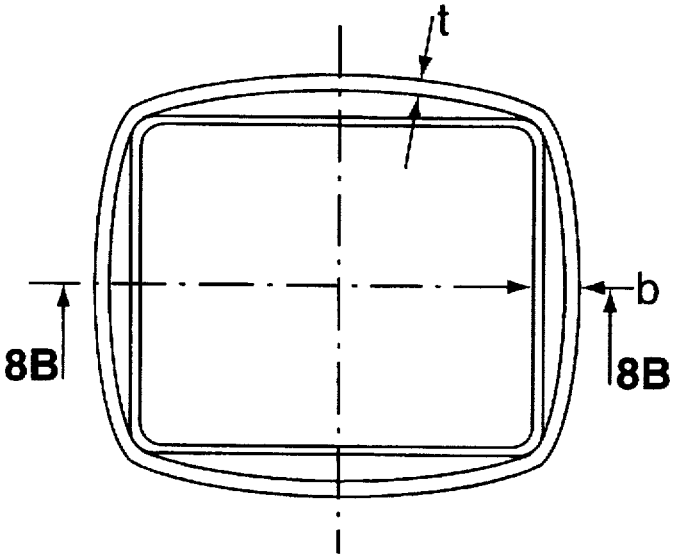
FIGS. 8*a* and 8*b* are plan and sectional views, respectively, of an ingot mold having a bulge at its pour-in side, where b is the extent to which the mold bulges and t is the wall thickness of the mold.
Figure 8B:
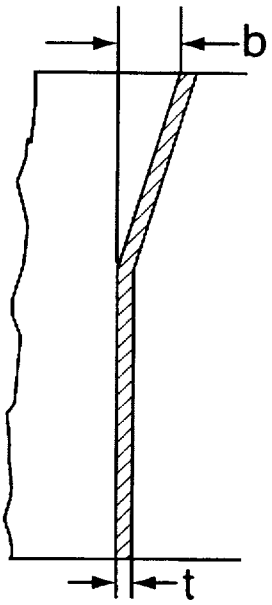

Other variations of the invention are contemplated and fall within the scope of the invention. For example, the invention is applicable both to ingot and plate molds. The middle axis of the ingot mold in the casting direction may be linear or curved (FIG. 4). The cross-sectional shape of the casting may be round (FIG. 5*a*), square (FIG. 5*b*), polygonal (FIG. 5*c*), or have a double-T shape as noted above (FIG. 6). The mold cavity may have a three-stage (FIG. 3) or parabolic conicity, and may have a bulge at the pour-in side that becomes smaller in the casting direction. For example, in the embodiment shown in FIGS. 8*a* and 8*b*, the mold cavity has a bulge b that extends for no more than 50% of the length of the ingot mold.

What is claimed is:

1. An ingot mold having a central longitudinal axis in a casting direction for the continuous casting of metals, including steel, comprising:

a mold cavity having a first opening at a pour-in side and a second opening at an opposite side from which the billet emerges, the cross-sectional area of the mold cavity at the pour-in-side being larger than at the end where the billet emerge, wherein the mold cavity has a multiple conical design; and an outer surface, said outer surface of said ingot mold having at least one region of axially interrupted depressions into said outer surface that define a cooling surface of elevated heat transfer.

2. The ingot mold according to claim 1, wherein the ingot mold central axis in the casting direction is straight.

3. The ingot mold according to claim 1, wherein the ingot mold central axis in the casting direction is curved.

4. The ingot mold according to claim 1, wherein the cross-sectional shape of the mold cavity is round.

5. The ingot mold according to claim 1, wherein the cross-sectional shape of the mold cavity is polygonal.

6. The ingot mold according to claim 1, wherein the cross-sectional shape of the mold cavity has a double-T shape.

7. The ingot mold according to claim 1, wherein the mold cavity is conical in three stages.

8. The ingot mold according to claim 1, wherein the mold cavity has a parabolically shaped conicity.

9. The ingot mold according to claim 1, wherein at least a portion of the cooling surface is roughened so as to provide sites of enhanced heat transfer.

10. The ingot mold according to claim 9, wherein the roughened region has a mechanically applied texture with a peak-to-valley height of $R_t$>1.5 μm.

11. The ingot mold according to claim 10, wherein the roughened region is provided in the area of the mold where the flowing metal experiences the greatest heat release.

12. The ingot mold according to claim 1, wherein the region of elevated heat transfer comprises depressions having a triangular cross-section, the center-to-center distance of the depressions lying in the range of 1 to 10 mm.

13. The ingot mold according to claim 1, wherein the region of elevated heat transfer comprises depressions that, when viewed along a plane that is orthogonal to the longitudinal axis of the mold, have a trapezoidal cross-section, the center-to-center distance of the depressions lying in the range of 1 to 10 mm.

14. The ingot mold according to claim 1, wherein the region of elevated heat transfer comprises depressions having a round cross-section, the center-to-center distance of the depressions lying in the range of 1 to 10 mm.

15. The ingot mold according to claim 1, wherein the region of elevated heat transfer comprises sub-regions of differingly shaped depressions within the surface.

16. The ingot mold according to claim 1, wherein the region of elevated heat transfer is provided in the area of the mold where the flowing metal experiences the greatest heat release.

17. The ingot mold according to claim 1, wherein the cooling-side surface has a structure which extends over an area symmetrical to a longitudinal axis of the casting surface and tapers in the casting direction.

18. The ingot mold according to claim 1, wherein the mold cavity has a bulge at the pour-in-side end which becomes smaller in the casting direction.

19. The ingot mold according to claim 18, wherein the length of the bulge amounts to a maximum of 50% of the ingot mold length.

20. The ingot mold according to claim 1, wherein the outer surface of the mold has both zones having depressions and zones characterized by roughened surface area.

21. The ingot mold according to claim 1, wherein the depressions are evenly spaced from one another.

22. The ingot mold according to claim 1, wherein the depressions are round dimples.

23. An ingot mold having a longitudinally extending axis, for the continuous casting of metals, comprising:

a mold cavity having a first opening at a pour-in side and a second opening at an opposite side from which the billet emerges, the cross-sectional area of the mold cavity at the pour-in-side being larger than at the end where the billet emerge; and an outer surface comprising at least one, outer cooling surface having at least one region on which is located a pattern of axially interrupted depressions that extend from the outer surface inwardly towards the mold cavity, said depressions serving to enhance the rate of heat transfer from the ingot mold.

* * * * *